US009486049B2

(12) United States Patent
Purkey

(10) Patent No.: US 9,486,049 B2
(45) **Date of Patent: *Nov. 8, 2016**

(54) HAIR LIFTING, RETENTION, AND STYLING DEVICE

(71) Applicant: Purkey Enterprises, LLC, Gainesville, FL (US)

(72) Inventor: Janet L. Purkey, Knoxville, TN (US)

(73) Assignee: Purkey Enterprises, LLC, Gainsville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/476,077

(22) Filed: Sep. 3, 2014

(65) Prior Publication Data

US 2015/0075552 A1 Mar. 19, 2015

Related U.S. Application Data

(60) Provisional application No. 61/879,701, filed on Sep. 19, 2013.

(51) Int. Cl.

| | |
|---|---|
| ***A45D 8/00*** | (2006.01) |
| ***A45D 8/38*** | (2006.01) |
| ***A45D 8/36*** | (2006.01) |

(52) U.S. Cl.
CPC .. *A45D 8/38* (2013.01); *A45D 8/36* (2013.01)

(58) Field of Classification Search
CPC ..... A45D 8/06; A45D 8/10; A45D 8/34; A45D 8/36; A45D 8/38
See application file for complete search history.

(56) References Cited

U.S. PATENT DOCUMENTS

| | | | | |
|---|---|---|---|---|
| 1,558,931 | A | 10/1925 | Senegas | |
| 2,868,214 | A | 1/1959 | Levy | |
| 3,031,681 | A | 5/1962 | Hoeflich | |
| 3,471,867 | A | 10/1969 | Kirchhoff | |
| 4,597,469 | A | 7/1986 | Nagashima | |
| 5,175,887 | A | 1/1993 | Kim | |
| 5,692,243 | A | 12/1997 | Chang | |
| 5,697,386 | A | 12/1997 | Chang | |
| 5,937,875 | A | 8/1999 | Wang | |
| 6,421,837 | B1 * | 7/2002 | Pearcy | 2/171 |
| D461,932 | S * | 8/2002 | Riva | D28/41 |
| 6,993,143 | B2 | 1/2006 | Harris et al. | |
| 7,156,106 | B2 | 1/2007 | Lawson | |
| 7,455,402 | B2 | 11/2008 | Gerber et al. | |
| D638,993 | S * | 5/2011 | Goodwin | D28/41 |
| 8,360,077 | B2 | 1/2013 | Defenbaugh et al. | |
| 8,422,718 | B2 | 4/2013 | Santiago | |
| 2005/0081280 | A1 | 4/2005 | Allgood | |
| 2008/0283082 | A1 * | 11/2008 | Jagemann | A45D 8/36 132/275 |
| 2010/0177907 | A1 | 7/2010 | Morisawa | |

* cited by examiner

*Primary Examiner* — Rachel Steitz
(74) *Attorney, Agent, or Firm* — Pitts & Lake, P.C.

(57) ABSTRACT

A hair lifting, retention, and styling device having a substantially rectilinear cross piece member having a first distal end and a second distal end and first and second substantially rectilinear side members cooperating with the substantially rectilinear cross piece member, wherein said first and second substantially rectilinear side members are disposed proximate said first and second distal ends of the cross piece member. Further, curved bight members are disposed between the cross piece member and the side members, such that the curvilinear design and the bight members co-act to provide lift and enhanced volume to a wearer's hair style thus augmenting and enhancing the wearer's chosen hairstyle.

8 Claims, 6 Drawing Sheets

HAIR LIFTING, RETENTION, AND STYLING DEVICE

CROSS-REFERENCE TO RELATED APPLICATIONS

This application claims the benefit of U.S. Provisional Patent Application No. 61/879,701, filed on Sep. 19, 2013, which is incorporated herein in its entirety by reference.

STATEMENT REGARDING FEDERALLY SPONSORED RESEARCH OR DEVELOPMENT

Not Applicable

BACKGROUND OF THE INVENTION

1. Field of Invention

This invention pertains to a woman's hair accessory; more specifically, the invention pertains to a hair lifting, retention, and styling device for providing enhanced volume to a wearer's hairstyle. More particularly, this invention pertains to a head-worn device that lifts the hair for the purpose of adding heightened, or enhanced, volume and shape to the wearer's hairstyle while simultaneously retaining a wearer's hair from in front of the wearer's face. Additionally, according to one embodiment of the present invention, the hair lifting, retention, and styling device is provided with cooperating hinges that allow the device to be folded for storing the device in a pocket or case when the device is not being worn.

2. Description of the Related Art

Curvilinear, or substantially curvilinear hair bands, sometimes referred to as headbands, have been long known in the art for keeping long hair out of the wearer's eyes and from in front of the wearer's face. The headband devices known and described in the art typically press, or pull, the hair tightly and press the hair flat against the wearer's head. Typical of these devices are the devices taught and described in the following U.S. Patents. U.S. Pat. No. 2,868,214, issued to J. M. Levy on Jan. 13, 1959, teaches and discloses a hair band with means for gripping the hair so as to substantially prevent slippage of the hair band. U.S. Pat. No. 3,031,681, issued to V. T. Hoeflich on May 1, 1962, discloses a tiara-like head-worn device as a novelty for parties. U.S. Pat. No. 3,471,867 issued to B. J. Kirchoff on Oct. 14, 1969, discloses a scarf-like device incorporating a flexible coil-type rib. U.S. Pat. No. 5,175,887 issued to Daniel S. Y. Kim on Jan. 5, 1993, discloses an absorbent headband having a resilient inner frame member. U.S. Pat. No. 5,692,243 issued to Wen Shyong Chang on Dec. 2, 1997, discloses a hair band having a main body and two retaining pieces releasably attached to the main body. U.S. Pat. No. 5,697,386 issued to Wen-Shyong Chang on Dec. 16, 1997 similarly discloses a hair band having releasably attached end members. U.S. Pat. No. 5,937,872 issued to Hsien Chu Wang on Aug. 17, 1999, discloses a foldable hair holder that is substantially curvilinear or arcuate. U.S. Pat. No. 5,987,647 issued to Jennifer Ouellette on Nov. 23, 1999, discloses an arcuate, or curvilinear, woman's headband and a method for its construction. U.S. Pat. No. 7,156,106 issued to Deborah Lawson on Jan. 2, 2007, discloses a foldable decorative hair band having an outwardly bowed bridging strip section that is adapted to receive a detachable decorative plate. Finally, U.S. Pat. No. 8,360,077 issued to Michael Defenbaugh et al. on Jan. 29, 2013, discloses a substantially curvilinear headband having pliable ends.

The known devices as described above are substantially curvilinear, or arcuate, which leads to them sharing the common trait that they are designed to pull the wearer's hair tightly and flatly against the wearer's head. What is missing from the known art is a substantially rectilinear hair lifting, retention, and styling device for adding volume, or enhanced shape, to the wearer's hairstyle and optimizing comfort.

BRIEF SUMMARY OF THE INVENTION

According to one embodiment of the present invention, a substantially rectilinear hair lifting, retention, and styling device is provided. The substantially rectilinear hair lifting, retention, and styling device, rather than pulling the wearer's hair flatly against the wearer's head, lifts the wearer's hair providing volume and enhanced shape to the wearer's hairstyle. While in one embodiment the main body, or cross piece of the hair lifting, retention, and styling device and its first and second side piece members could be of unitary design, in the another embodiment the first and second side piece members are attached to the cross piece member of the hair lifting, retention, and styling device by means of hinge members thereby allowing the hair lifting, retention, and styling device to be folded compactly when not in use thereby allowing for ease of storing the hair lifting, retention, and styling device in a user's pocket or case.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 4:
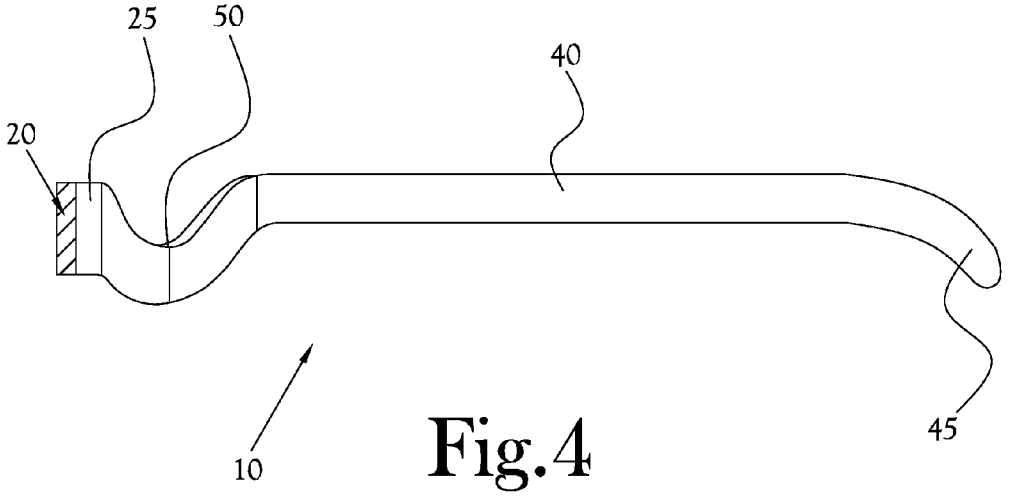
FIG. 4 is a top plan view of the hair lifting, retention, and styling device illustrated in FIG. 1.

A hair lifting, retention, and styling device 10 is disclosed. As compared to prior art head bands that are designed and intended to press the wearer's hair tightly and flatly against the wearer's head, the hair lifting, retention, and styling device 10 of the present invention is designed to add lift and volume to the wearer's hairstyle while simultaneously retaining the wearer's hair away from the wearer's face. As can be seen in FIG. 4, the hair lifting, retention, and styling device 10 has an elongated, substantially rectilinear cross piece member 20 having first and second distal ends 25. The term "substantially rectilinear", as used herein, includes a range from strictly straight, such that it defines a plane, to having a very slight arc such that the distal ends 25 of the cross piece member 20 do not deviate more than 0.20 inches, or more than approximately five percent of the length of cross piece member 20, from a line tangential with a midpoint of the cross piece member 20. The hair lifting, retention, and styling device 10 also includes elongated side members 40 carried proximate the cross piece member 20. Side members 40 terminate in distal end members 45. While distal end members 45 can be substantially co-linear with side members 40, in the preferred embodiment, distal end members 45 are angled slightly toward the wearer's head, as illustrated most clearly in FIGS. 1 and 4, thereby substantially reducing, if not altogether eliminating, headache-inducing pressure points against the wearer's skull as is commonly experienced with prior art head bands.

Figure 1:
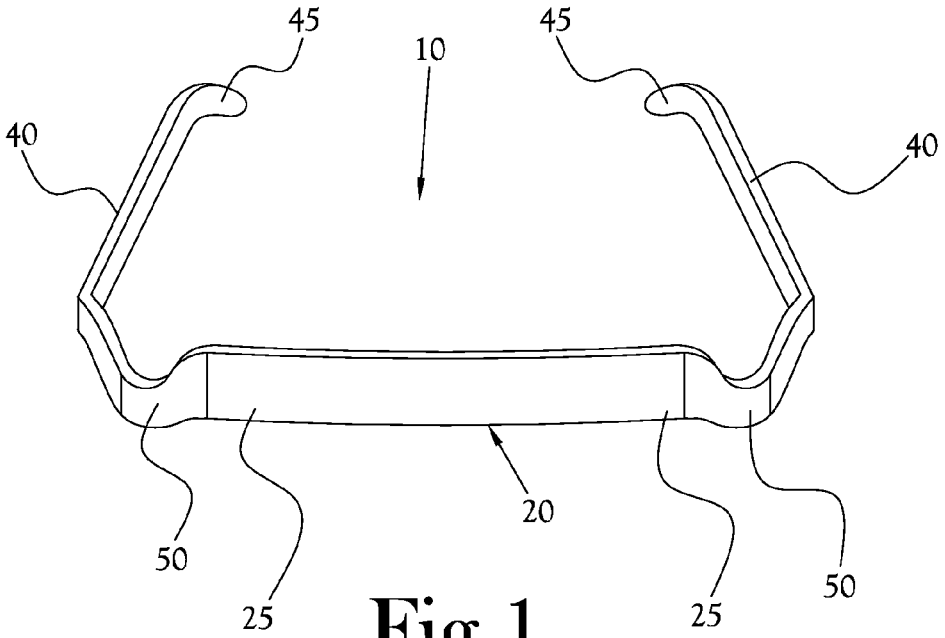
FIG. 1 is a perspective view of one embodiment of the hair lifting, retention, and styling device of the present invention.
Figure 2:
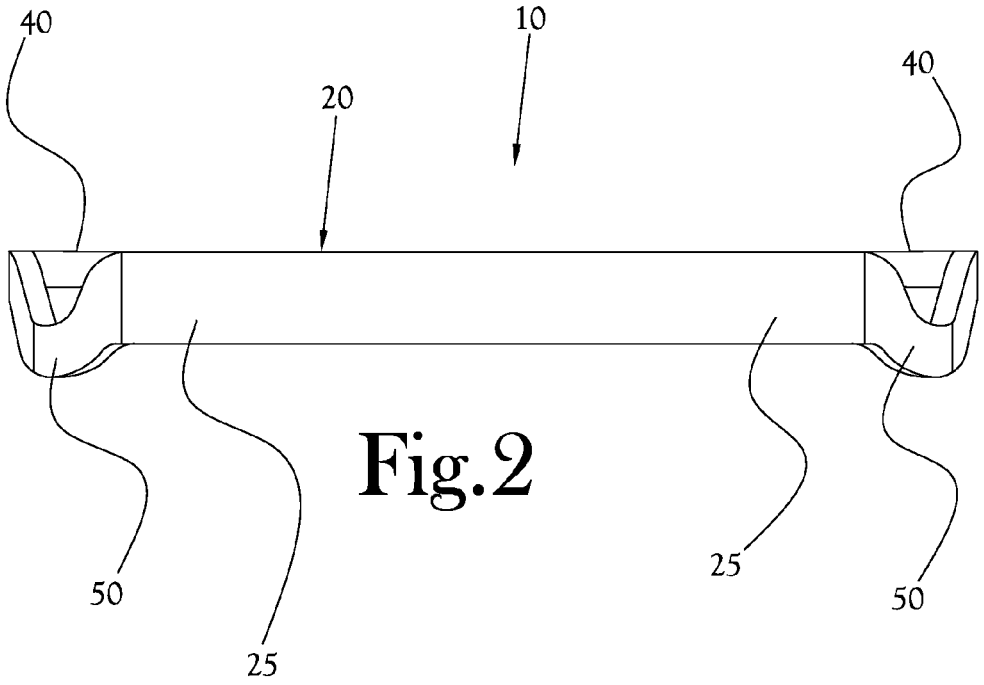
FIG. 2 is a front elevation view of the hair lifting, retention, and styling device illustrated in FIG. 1.
Figure 3:
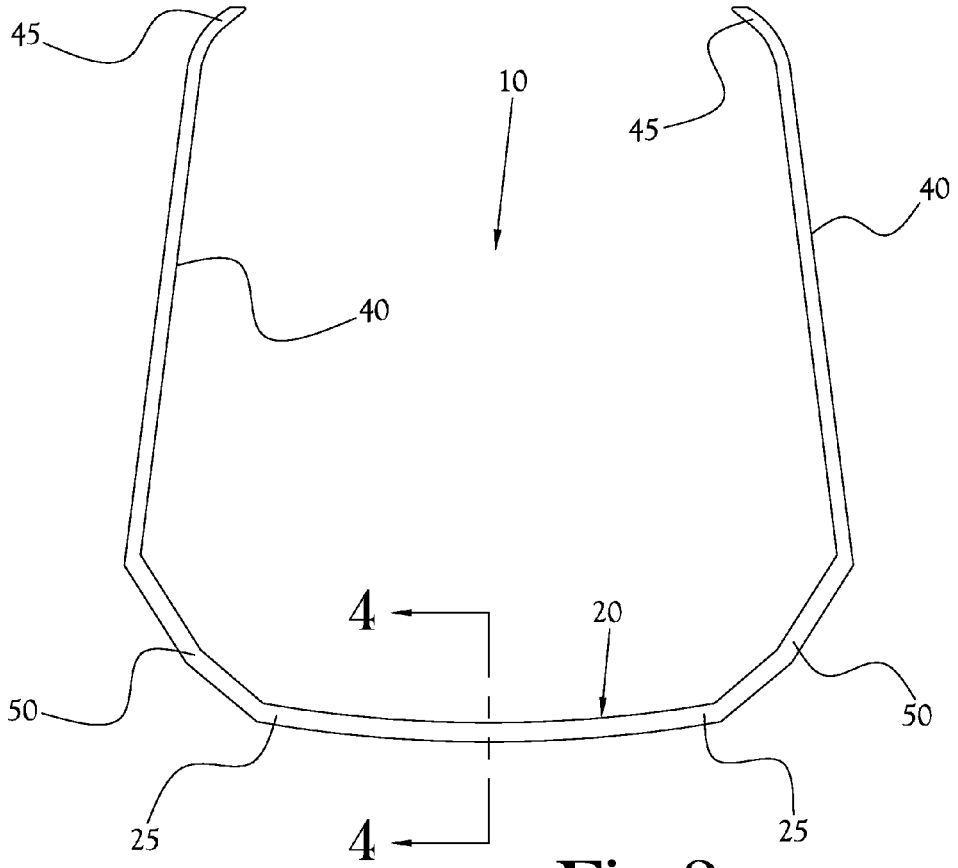
FIG. 3 is a side elevation view, in partial cross-section taken at cut line 2 in FIG. 3, of the hair lifting, retention, and styling device illustrated in FIG. 1.

As seen in FIGS. 1-4, angled side sections having, preferably, vertically oriented curved portions defining bight members 50 are disposed between side members 40 and the distal ends 25 of rectilinear cross piece member 20 thereby serving as a bridge between cross piece member 20 and the cooperating side members 40. One purpose of disposing bight member 50 between cross piece member 20 and the cooperating side members 40 is to selectively offset the cross piece member 20 from the cooperating side members 40 thereby reducing the "pointed" or squared off appearance of hair lifting, retention, and styling device 10 which, in turn can make the hair lifting, retention, and styling device 10 less conspicuous. Further, the relative angle of the bight members 50 with the cooperating cross piece member 20 and side members 40 can be selected based on the degree of preferred offset. Further, the curvature of the bight member 50 enhances the hair lifting and volume enhancing function of hair lifting, retention and styling device 10. As seen in FIGS. 1-3, the cross piece member 20 and the side members 40 have a substantially rectangular cross-section and the curvature of the bight members 50 is adapted to be pointed downward, see FIG. 3.

Figure 5:
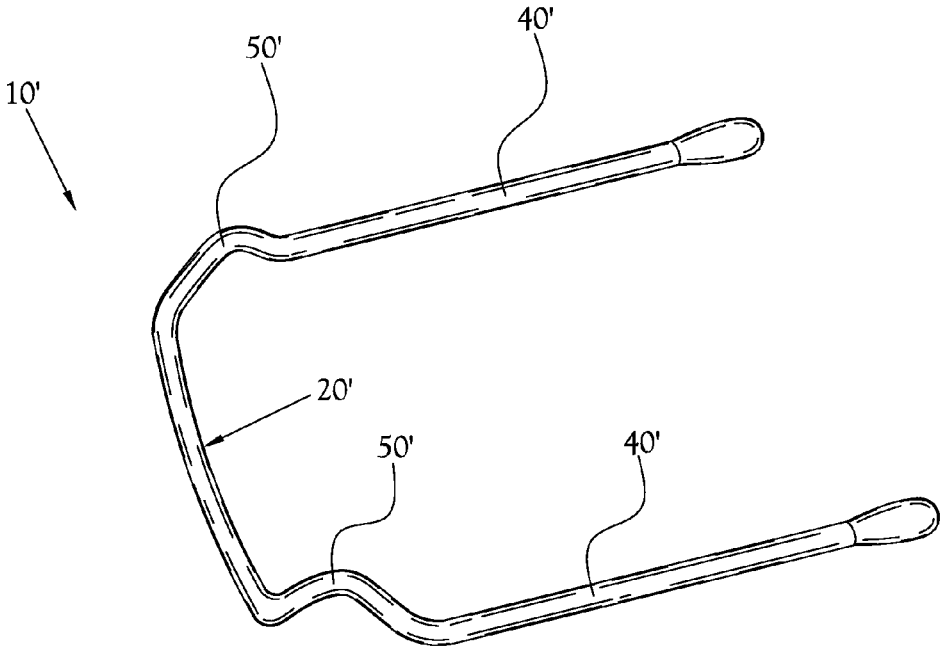
FIG. 5 is a perspective view of an alternate embodiment of the hair lifting, retention, and styling device of the present invention.
Figure 6:
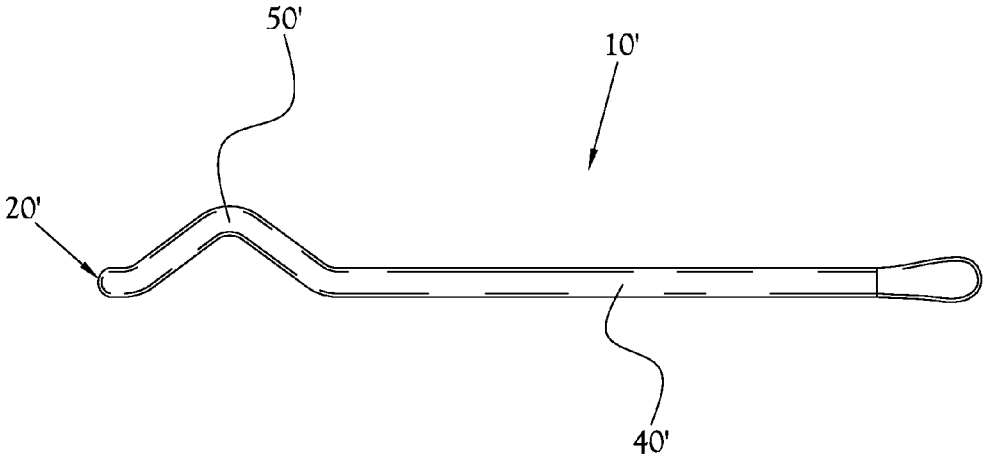
FIG. 6 is a front elevation view of the hair lifting, retention, and styling device illustrated in FIG. 4.
Figure 7:
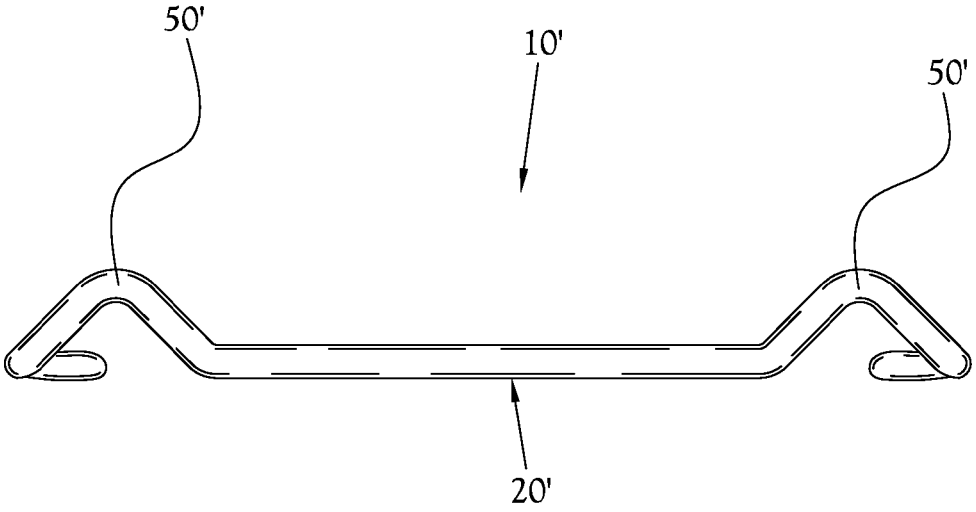
FIG. 7 is a side elevation view, in partial cross-section taken at cut line 7 in FIG. 6, of the hair lifting, retention, and styling device illustrated in FIG. 4.
Figure 8:
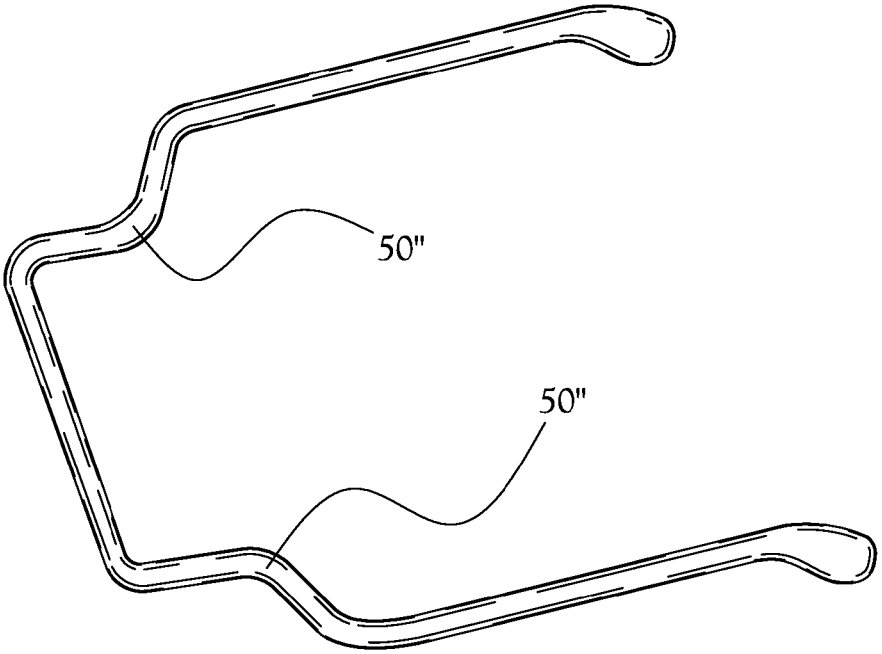
FIG. 8 is a perspective view of yet another alternate embodiment of the hair lifting, retention, and styling device of the present invention.

In an alternate embodiment of hair lifting, retention, and styling device 10', illustrated in FIGS. 5-7, the cross piece member 20' and elongated side members 40' have a substantially cylindrical cross-section. Further, the curved portion of bight members 50' are adapted to point upward, see FIG. 7. As seen in Figures, the bight members, 50 or 50', have a first portion that curves downwardly from substantially rectilinear cross piece member 20 and a second section that curves upwardly towards the respective substantially rectilinear side piece member 40. It will be appreciated that the terms "downwardly" and "upwardly" are relative terms depending on the orientation of the hair lifting, retention, and styling device of the present invention. It will be recognized that with respect to each of the various embodiments described herein, the present invention is not limited to the specific dimensions and radii of the bight members or the angles disposed between the bight members, and the cross piece member. In another embodiment, illustrated in FIG. 8, rather than curving downward or upward as described above, the bight members 50" curve inward. The bight members, in either embodiment, i.e. 50. 50', or 50", enhance the lift and natural flow of the wearer's hair, in the style to be maintained, unlike prior art "headbands" which compress the hair against the wearer's head inhibiting the hair's natural flow.

Figure 9A:
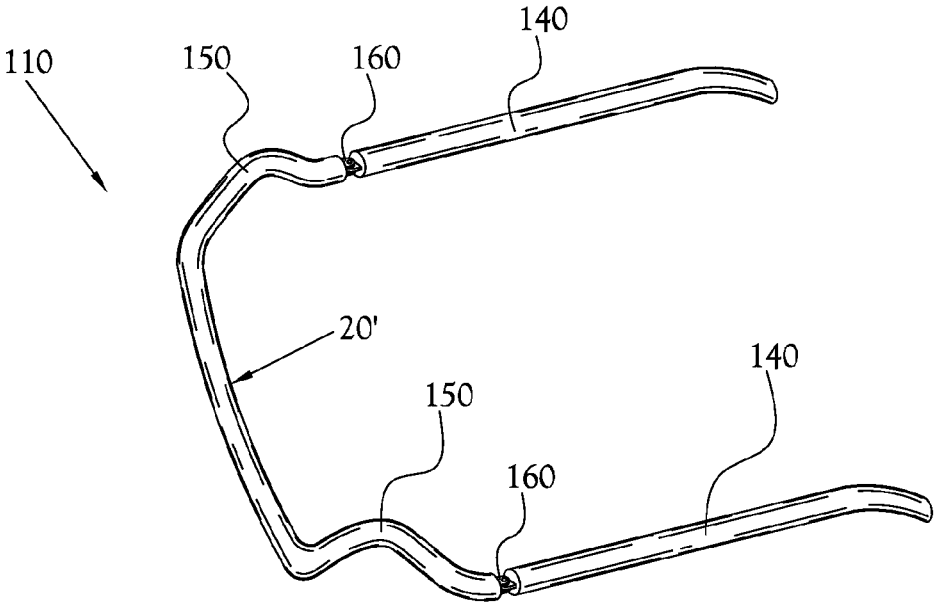
FIGS. 9A and 9B are perspective views of an alternate embodiment of the hair lifting, retention, and styling device illustrated in FIG. 1 having hinged side members.
Figure 9B:
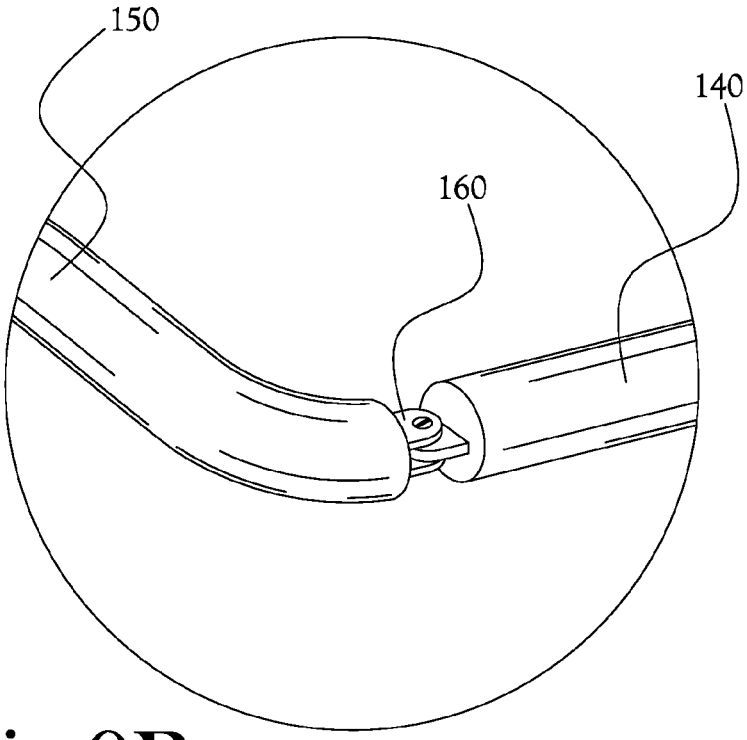

In still another alternate embodiment, illustrated in FIGS. 9A and 9B, in order to facilitate greater ease of storing and carrying the hair lifting, retention, and styling device of the present invention when it is not being worn, hair lifting, retention, and styling device 110, in FIGS. 9A and 9B, includes side members 140 which are hingedly connected with the bight members 150 by hinge members 160 such that the side members 140 can be folded inwardly when not being worn, thus allowing the hair lifting, retention, and styling device 110 to be folded and easily stowed in a pocket or a case when the hair lifting, retention, and styling device 110 is not in use.

Those skilled in the art will recognize that the hair lifting, retention, and styling devices described herein, i.e. preferred embodiment 10, alternate embodiment 10', and alternate embodiment 110 can be utilized as styling devices. In this regard, if the hair lifting, retention, and styling device 10, and the other embodiments, is positioned on the wearer's head while the wearer's hair is wet, the lifting and volume enhancing effect will last longer as it will "set", as will be understood by those skilled in the art, as the wearer's hair dries. This effect can be still further prolonged by the application of various hair products, such as hair sprays, mousses, and gels. The hair lifting, retention, and styling device 10, and the other disclosed embodiments, provide the taught lift and volume enhancement to substantially all types of hair and to hair of various lengths.

Figure 10:
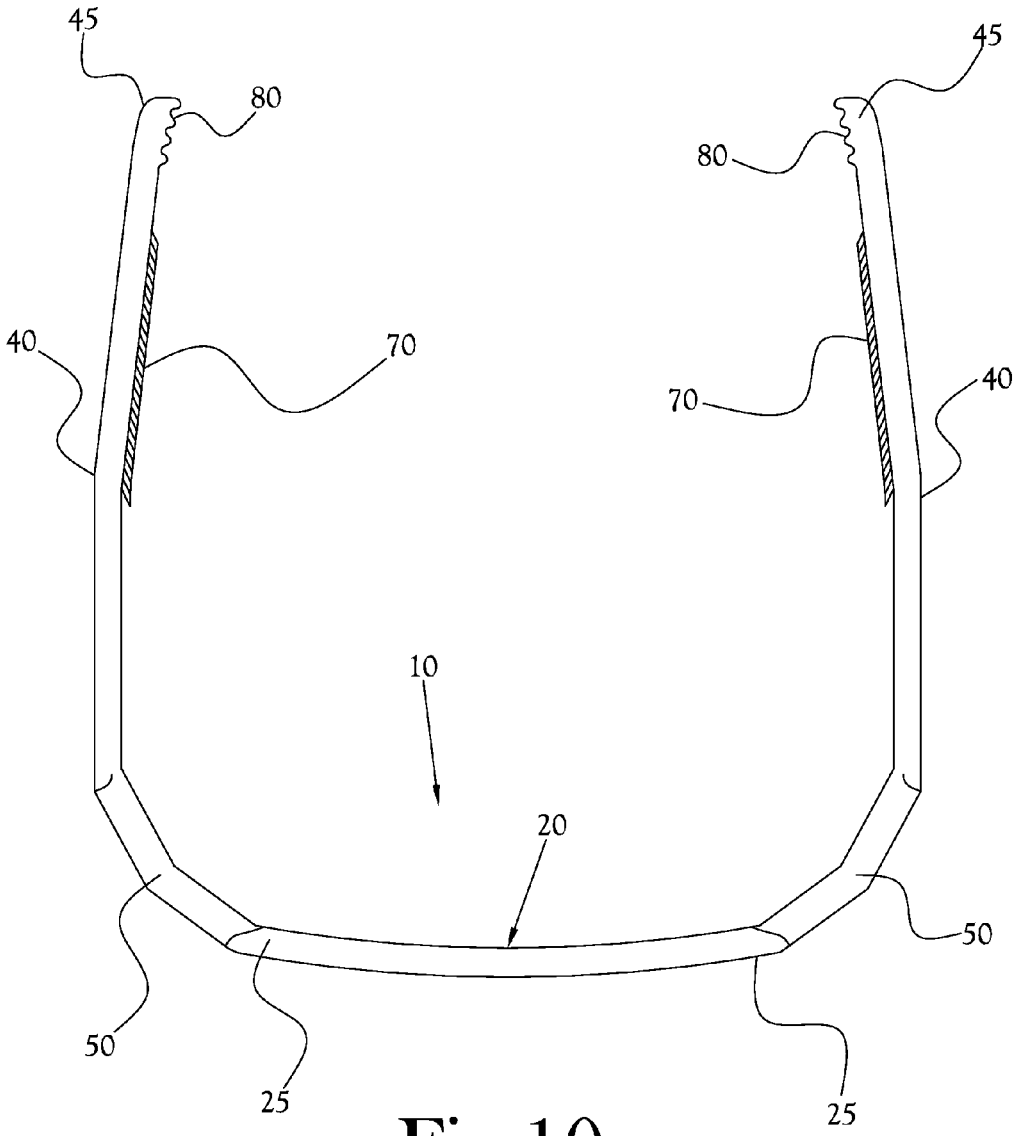
FIG. 10 is a top plan view of still a further embodiment of the hair lifting, retention, and styling device of the present invention.

It will be further recognized by those skilled in the art that in either the preferred embodiment hair lifting, retention, and styling device 10, or the other embodiments described herein, the interior surface of the portions of the cross piece member 20 and the side members 40 can be smooth or, as illustrated in FIG. 10, can have grooved portions 70 that are grooved, and the distal ends 45 of side members 40 can include serrations or teeth 80 for providing enhanced gripping of the wearer's hair without departing from the spirit and scope of the present invention.

It will be further appreciated by those skilled in the art that the preferred embodiment hair lifting, retention, and styling device 10, and the other embodiments described herein, can be constructed of a clear, translucent, or subtly colored material so as to render the device itself inconspicuous, such that attention is only drawn to the lift and volume enhancing effect produced in the wearer's hair. Alternatively, both the preferred embodiment hair lifting, retention, and styling device 10, and the alternate embodiments described herein, can be stylized or ornamented in many various ways, including but not limited to selected colors of materials, incorporation of woven threads, beading, and other forms of ornamentation as will be readily recognized by those skilled in the art.

From the foregoing description, it will be recognized by those skilled in the art that a hair lifting, retention, and styling device has been provided which provides lift and enhanced volume to a wearer's hair thus augmenting and enhancing the wearer's chosen hairstyle. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A hair lifting, retention, and styling device for lifting at least a portion of a wearer's hair thereby providing enhanced volume to said wearer's hairstyle and for retaining said hair from a wearer's face, said hair lifting, retention, and styling device comprising:

a substantially rectilinear cross piece member having a first distal end and a second distal end;

a first substantially rectilinear side piece member cooperating with said first distal end of said substantially rectilinear cross piece member, said first rectilinear side piece member having a distal end;

a second substantially rectilinear side piece member cooperating with said second distal end of said substantially rectilinear cross piece member, said second rectilinear side piece member having a distal end, whereby said distal ends of said first and said second rectilinear side members engage respective sides of said wearer's head; and a first vertically oriented curved bight member disposed between said cross piece member and said first substantially rectilinear side piece member, said first vertically oriented curved bight member having a first section that curves downwardly from said substantially rectilinear cross piece member and a second section that curves upwardly towards said first substantially rectilinear side piece member, and a second vertically oriented curved bight member disposed between said substantially rectilinear cross piece member and said second substantially rectilinear side piece member, said second vertically oriented curved bight member having a first section that curves downwardly from said substantially rectilinear cross piece member and a second section that curves upwardly towards said second substantially rectilinear side piece member, whereby said cross piece member is selectively offset from said first and second substantially rectilinear side piece members.

2. The hair lifting, retention, and styling device of claim 1 wherein said substantially rectilinear cross piece member is planar.

3. The hair lifting, retention, and styling device of claim 1 wherein said cross piece member and said side piece members have a substantially rectangular cross section.

4. The hair lifting, retention, and styling device of claim 1 wherein said cross piece member and said side piece members have a substantially circular cross section.

5. The hair lifting, retention, and styling device of claim 1 wherein said first and said second substantially rectilinear side piece members are in hinged connection with said substantially rectilinear cross piece member whereby said first and said second substantially rectilinear side piece members can be folded inwardly.

6. A hair lifting, retention, and styling device for lifting at least a portion of a wearer's hair thereby providing enhanced volume to said wearer's hairstyle and for retaining said hair from a wearer's face, said hair lifting, retention, and styling device comprising:

a substantially rectilinear cross piece member having a first distal end and a second distal end, wherein said substantially rectilinear cross piece member is planar;

a first substantially rectilinear side piece member cooperating with said first distal end of said substantially rectilinear cross piece member, said first rectilinear side piece member having a distal end;

a second substantially rectilinear side piece member cooperating with said second distal end of said substantially rectilinear cross piece member, said second rectilinear side piece member having a distal end, wherein said cross piece member and said side piece members have a substantially rectangular cross section; and a first angled side section member having a vertically oriented curved bight member disposed between said cross piece member and said first substantially rectilinear side piece member, said vertically oriented curved bight member having a first section that curves downwardly from said substantially rectilinear cross piece member and a second section that curves upwardly towards said first substantially rectilinear side piece member, and a second angled side section member having a vertically oriented curved bight member disposed between said cross piece member and said second substantially rectilinear side piece member, said vertically oriented curved bight member having a first section that curves downwardly from said substantially rectilinear cross piece member and a second section that curves upwardly towards said second substantially rectilinear side piece member, whereby said substantially rectilinear cross piece member is selectively offset from said first and second substantially rectilinear side piece members, whereby said first and said second angled side section members serve as bridge members between said cross piece member and said side piece members;

whereby said distal ends of said first and said second rectilinear side members engage respective sides of said wearer's head.

7. The hair lifting, retention, and styling device of claim 6 wherein said first and said second substantially rectilinear side piece members are in hinged connection with said substantially rectilinear cross piece member whereby said first and said second substantially rectilinear side piece members can be folded inwardly.

8. A hair lifting, retention, and styling device for lifting at least a portion of a wearer's hair thereby providing enhanced volume to said wearer's hairstyle and for retaining said hair from a wearer's face, said hair lifting, retention, and styling device comprising:

a substantially rectilinear cross piece member having a first distal end and a second distal end;

a first substantially rectilinear side piece member cooperating with said first distal end of said substantially rectilinear cross piece member, said first rectilinear side piece member having a distal end;

a second substantially rectilinear side piece member cooperating with said second distal end of said substantially rectilinear cross piece member, wherein said cross piece member and said side piece members have a substantially circular cross section, said second rectilinear side piece member having a distal end, and further wherein said first and said second substantially rectilinear side piece members are in hinged connection with said substantially rectilinear cross piece member whereby said first and said second substantially rectilinear side piece members can be folded inwardly; and a first vertically oriented curved bight member disposed between said cross piece member and said first substantially rectilinear side piece member, said first vertically oriented curved bight member having a first section that curves downwardly from said substantially rectilinear cross piece member and a second section that curves upwardly towards said first substantially rectilinear side piece member, and a second vertically oriented curved bight member disposed between said cross piece member and said second substantially rectilinear side piece member, said second vertically oriented curved bight member having a first section that curves downwardly from said substantially rectilinear cross piece member and a second section that curves upwardly towards said second substantially rectilinear side piece member, whereby said substantially rectilinear cross piece member is selectively offset from said first and second substantially rectilinear side piece members;

whereby said distal ends of said first and said second rectilinear side members engage respective sides of said wearer's head.

* * * * *